US009878818B2

(12) United States Patent
Grajales et al.

(10) Patent No.: US 9,878,818 B2
(45) Date of Patent: Jan. 30, 2018

(54) TAMPER RESISTANT BOX

(71) Applicant: Iron Mountain Incorporated, Boston, MA (US)

(72) Inventors: Rene Grajales, Weston, FL (US); Fred Dowd, Princeton, MA (US); Sandy Freeman, Springboro, OH (US)

(73) Assignee: Iron Mountain Incorporated, Boston, MA (US)

( * ) Notice: Subject to any disclaimer, the term of this patent is extended or adjusted under 35 U.S.C. 154(b) by 14 days.

(21) Appl. No.: 15/074,559

(22) Filed: Mar. 18, 2016

(65) Prior Publication Data

US 2016/0272362 A1 Sep. 22, 2016
US 2017/0233134 A9 Aug. 17, 2017

Related U.S. Application Data

(60) Provisional application No. 62/135,544, filed on Mar. 19, 2015.

(51) Int. Cl.
*B65D 5/66* (2006.01)
*B65D 5/02* (2006.01)
*B65D 5/42* (2006.01)

(52) U.S. Cl.
CPC ..... *B65D 5/6608* (2013.01); *B65D 5/0254* (2013.01); *B65D 5/4266* (2013.01)

(58) Field of Classification Search
CPC .. B65D 5/6608; B65D 5/4266; B65D 5/0254; B65D 5/46104
USPC ..... 229/102, 185, 120.04, 142, 148, 149, 229/150, 153, 108.1
See application file for complete search history.

(56) References Cited

U.S. PATENT DOCUMENTS 2,330,478 A * 9/1943 Englert ..... A45C 1/12 206/815
2,531,090 A * 11/1950 Turner ..... B65D 5/5014 206/391
3,226,007 A * 12/1965 Thies ..... B65D 5/0254 206/365
4,771,763 A * 9/1988 Wetzel, Jr. ..... F24J 2/42 126/636
5,060,850 A * 10/1991 Weaver ..... B65D 5/3685 229/117.06

* cited by examiner

*Primary Examiner* — Christopher DeMeree
(74) *Attorney, Agent, or Firm* — Kilpatrick Townsend & Stockton LLP

(57) ABSTRACT

A tamper resistant box includes: a front panel; a side panel attached to the front panel at a first fold line; a back panel attached to the side panel at a second fold line; a side top flap attached to the side panel at a third fold line; and a front top flap attached to the front panel at a fourth fold line. In some examples, the side top flap can define a tapered slot extending towards the third fold line from an edge of the side top flap at a location distal from the third fold line, and a widest portion of the tapered slot can define a tapered slot width. In further examples, the front top flap can define a top slot having a top slot width that is less than the tapered slot width.

17 Claims, 9 Drawing Sheets

TAMPER RESISTANT BOX

CROSS REFERENCE TO RELATED APPLICATIONS

This application claims the benefit of U.S. Provisional Application Ser. No. 62/135,544, filed on Mar. 19, 2015 and entitled TAMPER RESISTANT BOX, which is hereby incorporated in its entirety by this reference.

BACKGROUND

Field

This application relates to a template for a tamper resistant box, and a tamper resistant box formed from the template for receiving shreddable documents through a slot in a top of the tamper resistant box.

Background Technology

Individuals, businesses, and organizations often need to discard sensitive or otherwise important data, such as business records, client information, personal information, and various other types of data stored in a physical format rather than digitally. However, without proper safeguards, this information typically ends up in a trash bin or dumpster where it is readily available to anybody who desires to look through these waste containers.

Often, individuals, business, and organizations may rely on document destruction service providers to discard and destroy this information to ensure that it cannot be obtained by others. However, because individuals and businesses often rely on third party shipping services to get the information to the document destruction service providers, safeguards against tampering and other types of unauthorized access to the information is needed.

BRIEF DESCRIPTION OF THE DRAWINGS

The features and components of the following figures are illustrated to emphasize the general principles of the present disclosure. Corresponding features and components throughout the figures can be designated by matching reference characters for the sake of consistency and clarity.

DETAILED DESCRIPTION

Figure 1:
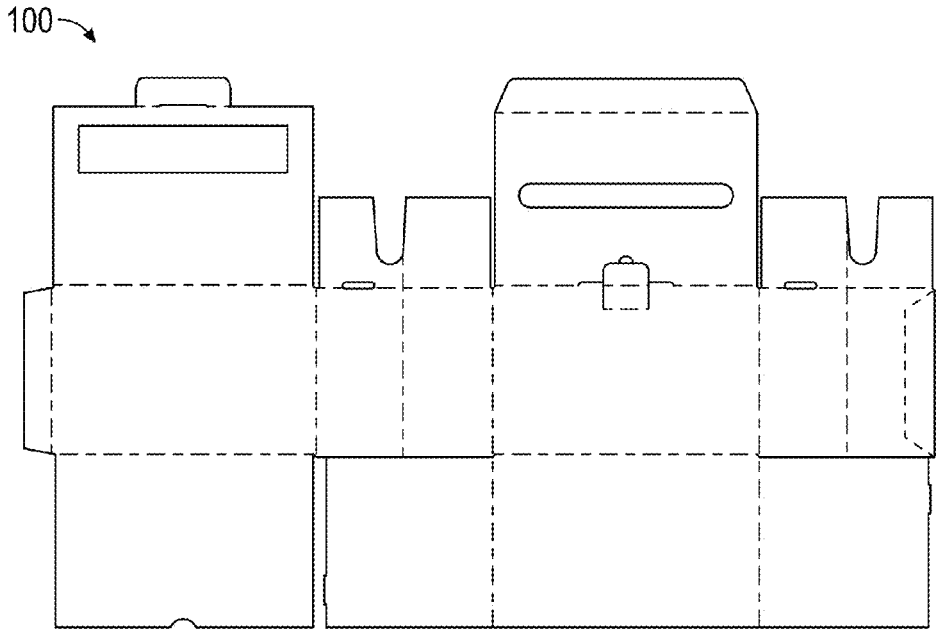
FIG. 1 is a top view of a blank for a tamper resistant box in accordance with an example of the current disclosure.

The present invention can be understood more readily by reference to the following detailed description, examples, drawings, and claims, and their previous and following description. However, before the present devices, systems, and/or methods are disclosed and described, it is to be understood that this invention is not limited to the specific devices, systems, and/or methods disclosed unless otherwise specified, and, as such, can, of course, vary. It is also to be understood that the terminology used herein is for the purpose of describing particular aspects only and is not intended to be limiting.

The following description of the invention is provided as an enabling teaching of the invention in its best, currently known embodiment. To this end, those skilled in the relevant art will recognize and appreciate that many changes can be made to the various aspects of the invention described herein, while still obtaining the beneficial results of the present invention. It will also be apparent that some of the desired benefits of the present invention can be obtained by selecting some of the features of the present invention without utilizing other features. Accordingly, those who work in the art will recognize that many modifications and adaptations to the present invention are possible and can even be desirable in certain circumstances and are a part of the present invention. Thus, the following description is provided as illustrative of the principles of the present invention and not in limitation thereof.

As used throughout, the singular forms "a," "an" and "the" include plural referents unless the context clearly dictates otherwise. Thus, for example, reference to "a band" can include two or more such bands unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

As used herein, the terms "optional" or "optionally" mean that the subsequently described event or circumstance can or can not occur, and that the description includes instances where said event or circumstance occurs and instances where it does not.

The word "or" as used herein means any one member of a particular list and also includes any combination of members of that list. Further, one should note that conditional language, such as, among others, "can," "could," "might," or "can," unless specifically stated otherwise, or otherwise understood within the context as used, is generally intended to convey that certain aspects include, while other aspects do not include, certain features, elements and/or steps. Thus, such conditional language is not generally intended to imply that features, elements and/or steps are in any way required for one or more particular aspects or that one or more particular aspects necessarily include logic for deciding, with or without user input or prompting, whether these features, elements and/or steps are included or are to be performed in any particular embodiment. Directional references such as "up," "down," "top," "left," "right," "front," "back," and "corners," among others are intended to refer to the orientation as illustrated and described in the figure (or figures) to which the components and directions are referencing.

In one aspect, disclosed is a tamper resistant box and associated methods, systems, devices, and various apparatus. The tamper resistant box can be suitable for receiving shreddable documents through a slot in a top of the box. The tamper resistant box can comprise a panel for securely covering the slot and sealing the box. In another aspect, disclosed is a method of arranging shipment of the tamper resistant box. In one aspect, the method can comprise an owner of the tamper resistant box containing shreddable documents arranging to transport the tamper resistant box to a secure shredding facility by way of a certified shipper. The method can also comprise sending the owner a certificate of completion from the shredding facility indicating that the contents of the tamper resistant box have been shredded. It would be understood by one of skill in the art that the disclosed tamper resistant box and method are described in but a few exemplary aspects among many.

In the Figures described below, dotted lines indicate score lines and solid lines indicate cuts between panels or edges or areas where a cut is made. In alternative examples with non-foldable materials, such as wood, the dotted lines can represent the abutment lines between two panels and having hinges or other attachment mechanisms attached to the panels to facilitate folding. The terms score, cut, cut out, and fold are intended to have their ordinary meaning as is known in the art.

Figure 2:
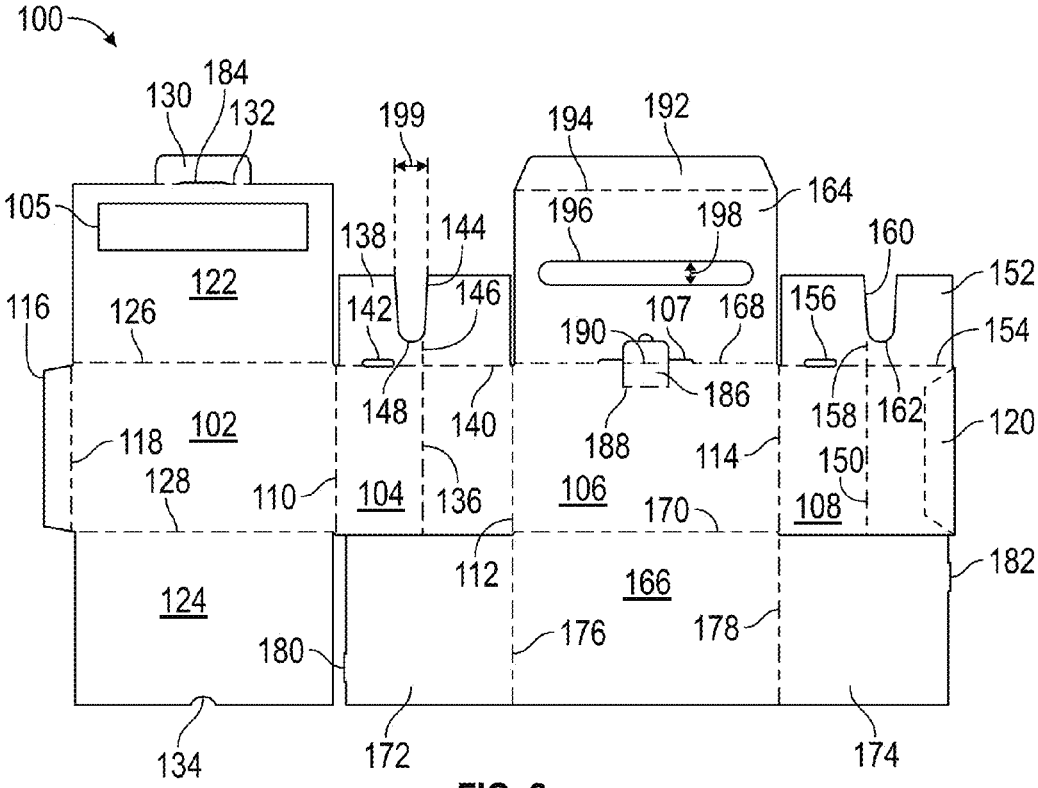
FIG. 2 is another top view of the blank of FIG. 1.

Referring to FIGS. 1 and 2, an example of a blank 100 for a tamper resistant box is illustrated. FIG. 1 illustrates the blank 100 without any annotations and FIG. 2 illustrates the blank 100 with annotations. As illustrated, in some examples, the blank 100 comprises a back panel 102, a first side panel 104, a front panel 106, and a second side panel 108. The panels can be attached as follows: the back panel 102 can be attached to the first side panel 104 at a fold line 110; the first side panel 104 can be attached to the front panel 106 at a fold line 112; and the front panel 106 can be attached to the second side panel 108 at a fold line 114. As illustrated in FIGS. 1 and 2, in one aspect, a securing panel 116 can be attached to the back panel 102 at a fold line 118 and a securing region 120 can be defined on the side panel 108. As described in greater detail below, to form the blank 100 into a tamper resistant box, in one aspect, the securing panel 116 can be secured at the securing region 120. It will be appreciated that the location of the securing panel 116 and the securing region 120 on the back panel 102 and the second side panel 108, respectively, should not be considered limiting on the current disclosure as it is contemplated that the securing panel 116 and securing region 120 can be on any of the panels 102, 104, 106, and 108 depending on the order of the panels 102, 104, 106, and 108 on the blank 100. As one non-limiting example, the order of the panels 102, 104, 106, and 108 may be rearranged such that when the blank 100 is viewed as in FIGS. 1 and 2, the first side panel 104 is the left-most panel and the back panel 102 is the right-most panel (attached to the second side panel 108). In this non-limiting example, the securing panel 116 would be attached to the first side panel 104 and the securing region 120 would be defined on the back panel 102.

Figure 11:
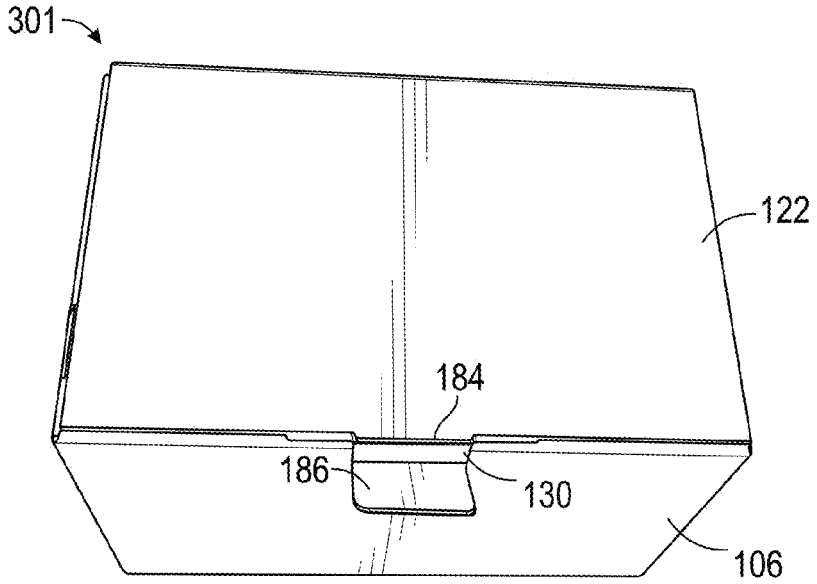
FIG. 11 is another perspective view of the tamper resistant box of FIG. 3 fully assembled.

In one aspect, a top back flap 122 and a bottom back flap 124 can be attached to the back panel 102 at fold lines 126 and 128, respectively. The top back flap 122 can comprise a securing flap 130 attached to an edge of the top back flap 122 at a fold line 132 distal from the fold line 126. As described in greater detail below with reference to FIG. 11, in one aspect when the securing flap 130 is folded along the fold line 132, a slot 184 can be defined. In another aspect, the bottom back flap 124 can define a gripping cut 134 at an edge of the bottom back flap 124 distal from the fold line 128. In some aspects, the top back flap 122 can comprise a securing mechanism 105, such as an adhesive, fastener, or other suitable securing mechanism, which can be utilized to secure the top back flap 122 as described in greater detail below. One having skill in the art will appreciate that the number of securing mechanisms 105 should not be considered limiting on the current disclosure.

As illustrated in FIGS. 1 and 2, in a further aspect, the first side panel 104 can define a center fold line 136 extending across the first side panel 104 between the fold lines 110 and 112. In this aspect, the center fold line 136 can be defined along a center line between the fold lines 110 and 112.

In another aspect, the blank 100 can comprise a first side top flap 138 attached to the first side panel 104 at a fold line 140. As illustrated in FIGS. 1 and 2, the first side top flap 138 can define a cut out 142 that can be dimensioned to receive a tab, as described below. In yet another aspect, the first side top flap 138 can define a center fold line 146 that is aligned with the center fold line 136 of the first side panel 104. In this aspect, the center fold lines 136 and 146 can define a continuous center fold line. The first side top flap 138 can define a side slot 144 extending towards the fold line 140 from an edge distal from the fold line 140. In one aspect, the side slot 144 can be defined offset from the center fold line 146 such that an innermost extent 148 of the slot 144 is not aligned with the center fold line 146. In other words, the central axis (not shown) of the side slot 144 does not align with the central fold line 146. In another aspect, it is contemplated that the side slot 144 can be aligned with the center fold line 146 such that the innermost extent 148 of the slot 144 is aligned with the center fold line 146.

Similar to the first side panel 104, the second side panel 108 can define a center fold line 150 extending across the second side panel 108. In this aspect, the center fold line 150 can be substantially parallel to the fold line 114. In one aspect, the center fold line 150 can be defined along a center line between the fold line 114 and an edge of the second side panel 108 distal from the fold line 114.

In a further aspect, the blank 100 can comprise a second side top flap 152 attached to the second side panel 108 at a fold line 154. The second side top flap 152 can define a cut out 156 that can be dimensioned to receive a tab, as described below. In another aspect, the second side top flap 152 can define a center fold line 158 that is aligned with the center fold line 150. In this aspect, the center fold lines 150 and 158 can define a continuous center fold line. The second side top flap 152 can define a slot 160 extending towards the fold line 154 from an edge distal from the fold line 154. In one aspect, the slot 160 can be defined offset from the center fold line 158 such that an innermost extent 162 of the slot 160 is not aligned with the center fold line 158. In other words, the central axis (not shown) of the slot 160 does not align with the central fold line 158. In another aspect, it is contemplated that the slot 160 can be aligned with the center fold line 158 such that the innermost extend 162 of the slot is aligned with the center fold line 158. It is contemplated that the slots 144 and 160 defined offset from the center fold lines 146 and 158, respectively, can reduce weakening of the top flaps 138 and 152, respectively, and can reduce the likelihood of tearing along the center fold lines 146 and 158, respectively.

Still referring to FIGS. 1 and 2, in another aspect, the blank 100 can comprise a top front flap 164 attached to the front panel 106 at a fold line 168 and a bottom front flap 166 attached to the front panel 106 at a fold line 170. In some aspects, the front panel 106 can define a securing slot 107, which is described in greater detail below. In one aspect, the blank 100 can further comprise a first side bottom flap 172 attached to the bottom front flap 166 at a fold line 176 and a second side bottom flap 174 attached to the bottom front flap 166 at a fold line 178. In another aspect, it is contemplated that the first side bottom flap 172 can define a first locking tab 180 at an edge distal from the fold line 176 and the second side bottom flap 174 can define a second locking tab 182 at an edge distal from the fold line 178. As described in greater detail below, when the blank 100 is assembled to form the tamper resistant box, the first locking tab 180 can be positioned within the cut out 142 defined in the first side top flap 138 and the second locking tab 182 can be positioned within the cut out 156 defined in the second side top flap 152.

In a further aspect, the blank 100 can comprise a closing flap 192 attached to the top front flap 164 at a fold line 194. In another aspect, the top front flap 164 can define a top slot 196. In some aspects, it is contemplated that the top slot 196 can be aligned along a center line of the top front flap 164 extending substantially parallel to the fold lines 168 and 194; however, it is also contemplated that in other aspects, the slot 196 can be offset from the center line such that the slot 196 is positioned closer to either fold line 168 or fold line 194. In another aspect, it is contemplated that a width 198 of the slot 196 may be less than a width 199 of the slot 144 (which is the same as a width of the slot 160). As described in greater detail below, when the blank 100 is assembled to form the tamper resistant box, the top front flap 164 can be folded on top of the top flaps 138 and 152 such that the slot 196 is positioned over the slots 144 and 160. It is contemplated that in those aspects where the width 198 is less than the width 199, a tolerance for misalignment of the flaps 138,152,164 may be provided. One having skill in the art will appreciate that, because the slot 196 is intended to be positioned above the slots 144 and 160, the positioning of the slot 196 on the top front flap 164 may be related to the positioning of the slots 144 and 160 on the top flaps 138 and 152, respectively. However, it is also contemplated that because the widths of the slots 144 and 160 are greater than the width 198 of the slot 196, the slots 144 and 160 can be offset even in those examples where the slot 196 is centrally aligned.

As illustrated in FIGS. 1 and 2, the blank 100 can comprise a securing flap 186 attached to the front panel 106 at a fold line 188. In some aspects, the securing flap 186 can define an intermediary fold line 190. As described in greater detail below, when the blank 100 is assembled to form the tamper resistant box, the securing flap 186 may be folded along the fold lines 188 and 190 such that the securing flap 186 can be inserted into the slot 184.

Referring to FIGS. 3-11, a tamper resistant box 301 formed from the blank 100 is illustrated. In one aspect, the tamper resistant box 301 can receive shreddable documents through the slot 196 in the top of the tamper resistant box 301.

To assemble the tamper resistant box 301 for retail packaging, in one aspect, a suitable adhesive, such as various glues, tapes, or other types of adhesives, may be extruded onto the second side panel 108 in the securing region 120. The back panel 102 can be folded along the fold line 110 and the second side panel 108 can be folded along the fold line 114 such that the securing panel 116 can contact the securing region 120. For example and without limitation, in some aspects, the back panel 102 may be folded 180 degrees along the fold line 110 and the second side panel 108 may be folded 180 degrees along the fold line 114 such that the securing panel 116 can contact the securing region 120. The adhesive at the securing region 120 may secure the securing panel 116 to the second side panel 108 such that once the adhesive sets, four contiguous panels are formed, which can be knocked down (illustrated in FIG. 4) for shipping and retail packaging and then shaped into a rectangular tube by a customer as explained below. It is also contemplated that mechanical fasteners or connectors, such as hinges, pins, clips, and various other suitable mechanisms may be utilized in place of the adhesive. Once purchased by the customer, the tamper resistant box 301 may be assembled.

Figure 5:
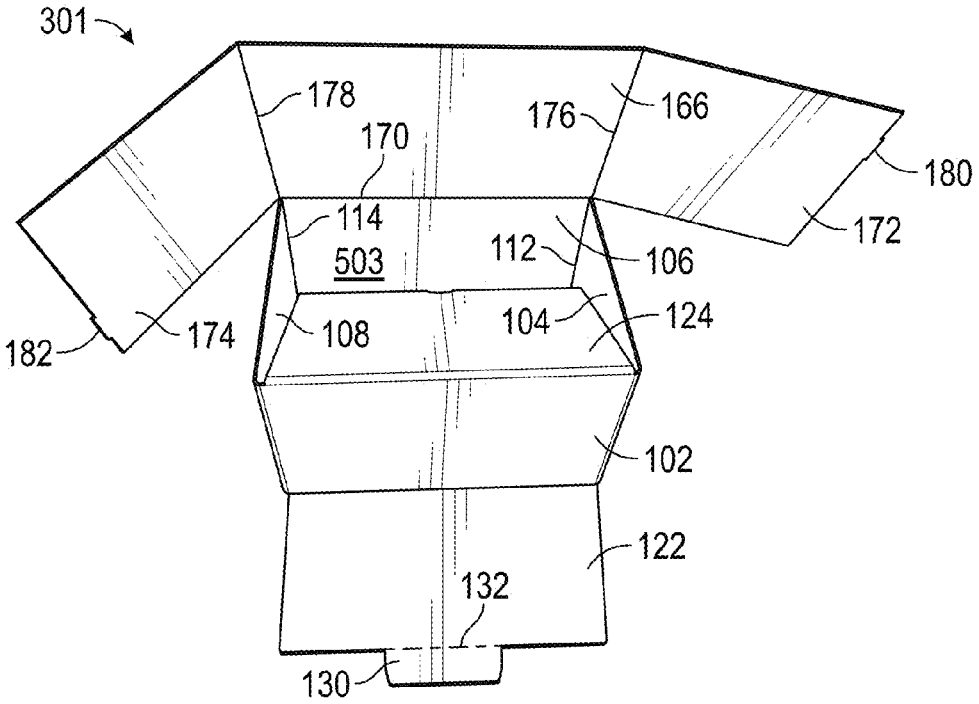
FIG. 5 is a perspective view of the tamper resistant box of FIG. 3 partially assembled.
Figure 6:
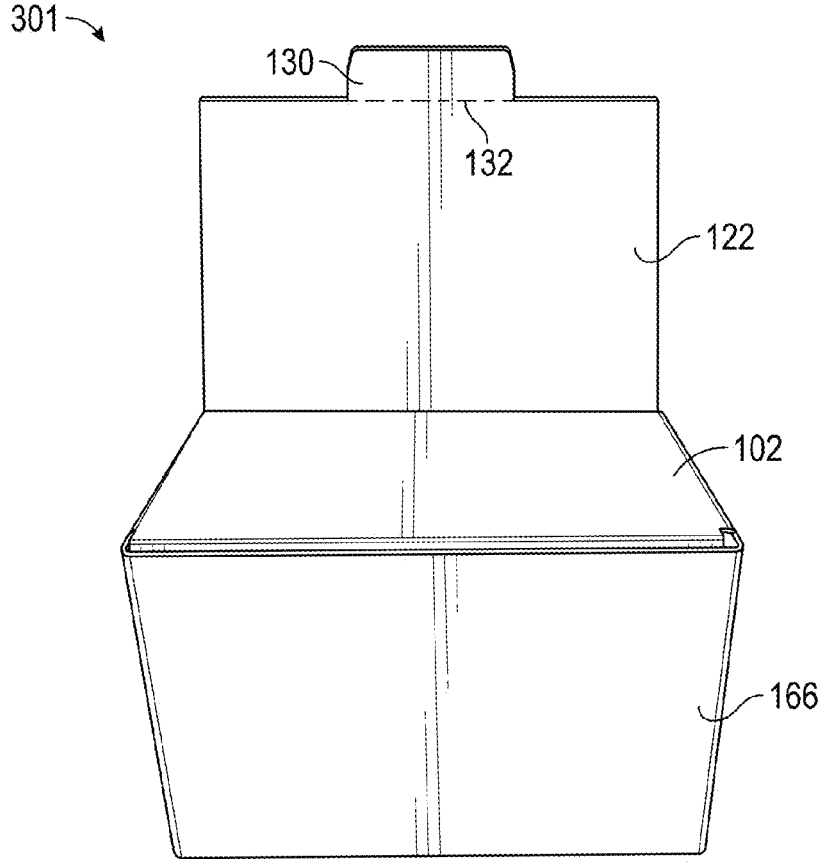
FIG. 6 is another perspective view of the tamper resistant box of FIG. 3 partially assembled.
Figure 7:
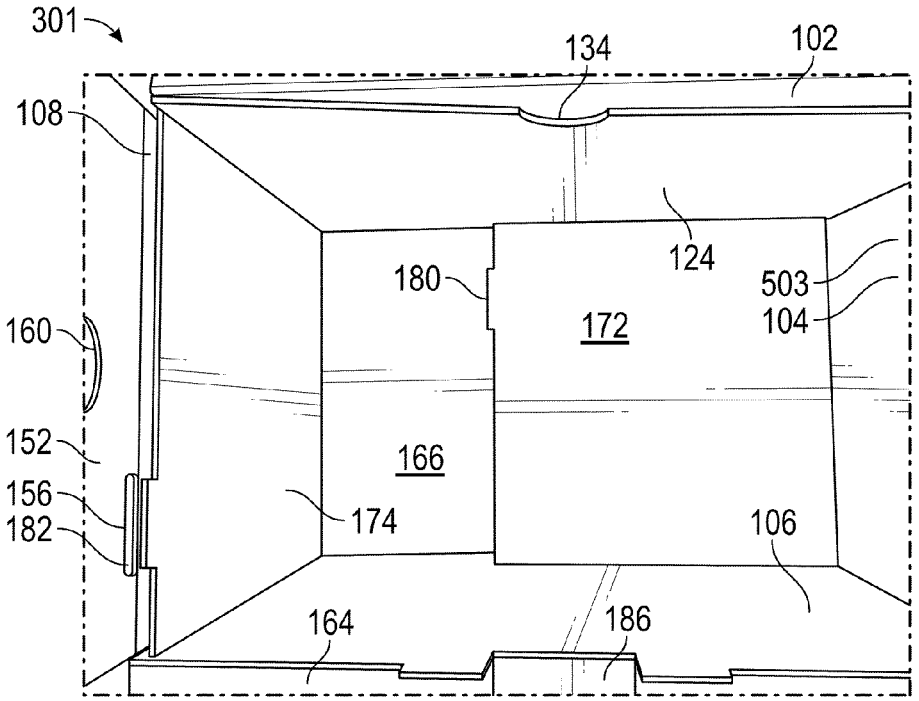
FIG. 7 is another perspective view of the tamper resistant box of FIG. 3 partially assembled.
Figure 8:
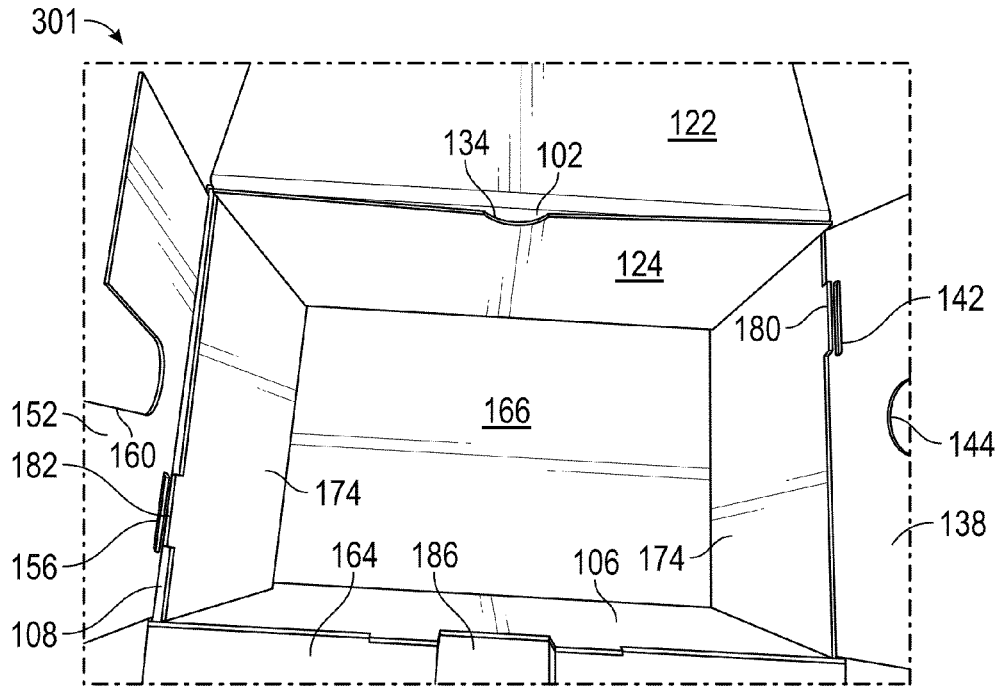
FIG. 8 is another perspective view of the tamper resistant box of FIG. 3 partially assembled.

Referring to FIGS. 2 and 5-8, to assemble a bottom of the tamper resistant box 301, the customer may square up the panels 102, 104, 106, and 108 to form a rectangular tube defining a cavity 503. The bottom back flap 124 can be folded along the fold line 128 such that the bottom back flap 124 is adjacent to the back panel 102 (as shown in FIGS. 2 and 5). In some aspects, the bottom back flap 124 can be folded at 180 degrees along the fold line 128 such that the bottom back flap 124 is against the back panel 102. The side bottom flaps 172 and 174 can be folded along the fold lines 176 and 178, respectively, such that they are adjacent to the bottom front flap 166. In some aspects, the side bottom flaps 172 and 174 are folded 180 degrees along fold lines 176 and 178, respectively, against bottom front flap 166. The bottom front flap 166 can be folded toward cavity 503 along the fold line 170 to form the bottom outside of the tamper resistant box 301. In some aspects, the bottom front flap 166 is folded 90 degrees along the fold line 170 to form the bottom outside of the tamper resistant box 301.

In some examples, after the bottom front flap 166 is folded, the bottom front flap 166 can be substantially perpendicular to the panels 102-108. In these examples, once the bottom front flap 166 is substantially perpendicular to the panels 102, 104, 106, and 108 (or positioned at an angle of about 90 degrees relative to the panels 102-108), the first side bottom flap 172 can be unfolded to be at least adjacent to the first side panel 104 and the second side bottom flap 174 can be unfolded to be at least adjacent to the second side panel 108. In some aspects, the side bottom flaps 172 and 174 are positioned against the side panels 104 and 108, respectively. In other aspects, the side bottom flaps 172 and 174 are unfolded such that they are substantially perpendicular to the bottom front flap 166. The bottom back flap 124 can be unfolded relative to the back panel 102 such that the bottom back flap 124 is on top of the bottom front flap 166. In some aspects, the bottom back flap 124 is positioned against the bottom front flap 166 and forms a second layer on the bottom of the tamper resistant box 301, on top of bottom front flap 166. In other aspects, the bottom back flap 124 can be substantially perpendicular to the back panel 102. In some examples, positioning the bottom back flap 124 to form the second layer on the bottom of the tamper resistant box 301 completes the assembly of the bottom of the tamper resistant box 301.

Figure 9:
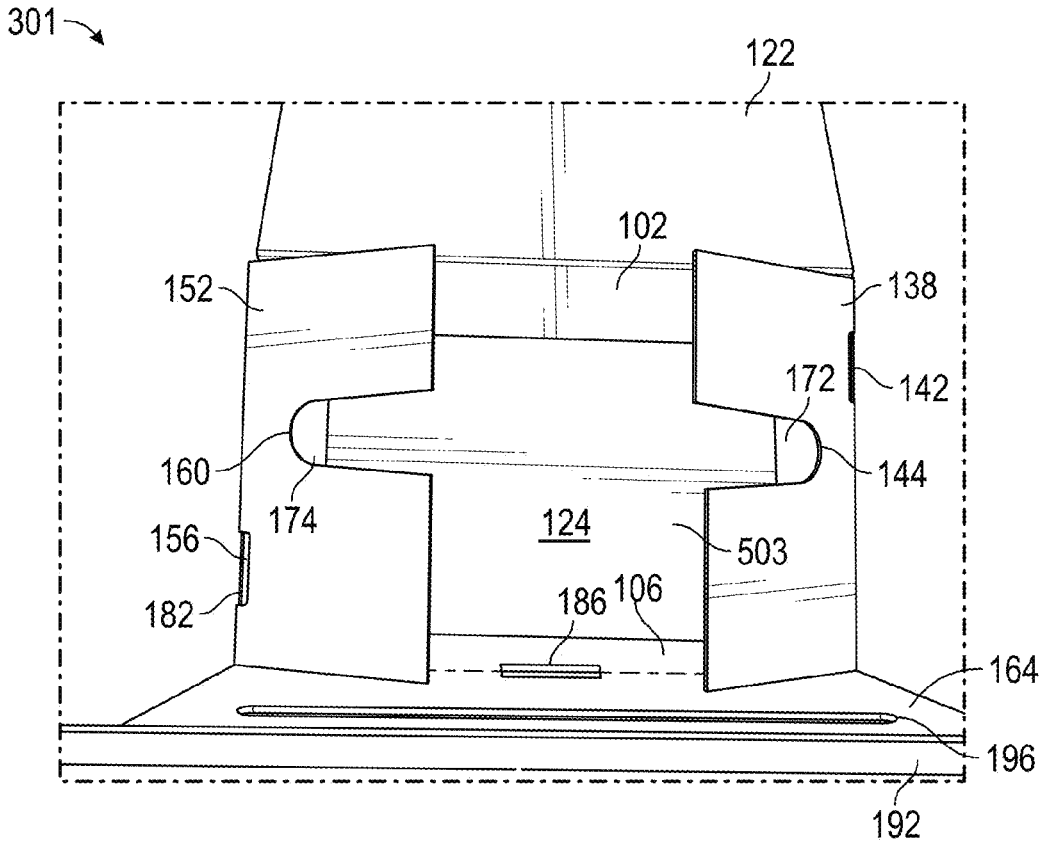
FIG. 9 is another perspective view of the tamper resistant box of FIG. 3 partially assembled.
Figure 10:
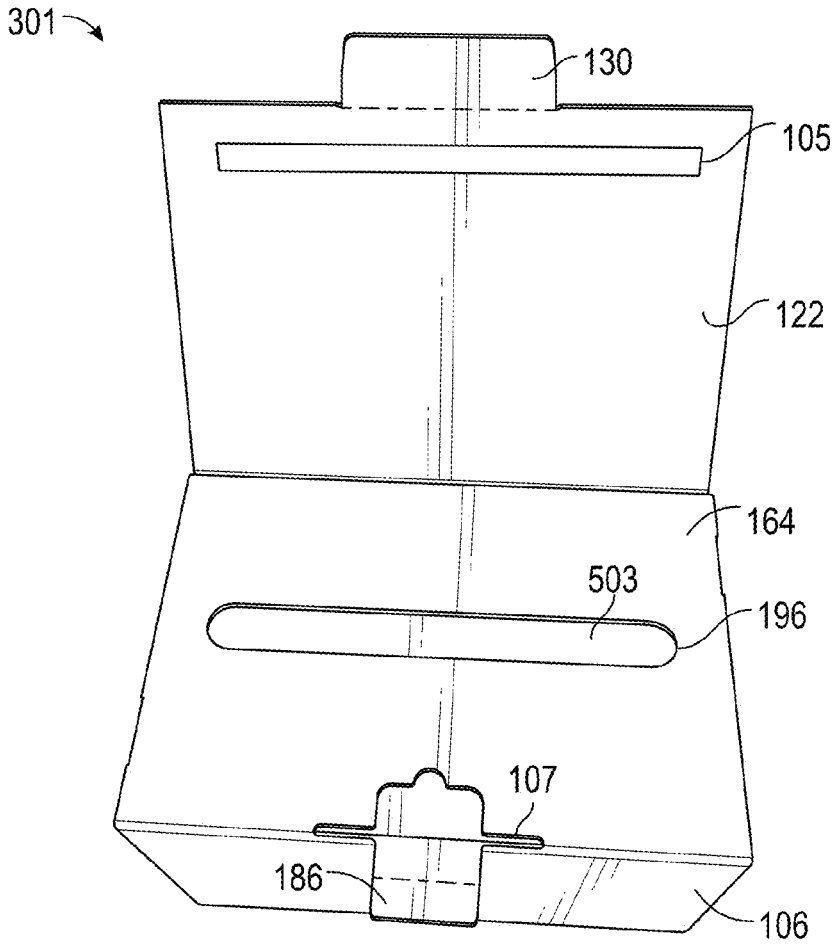
FIG. 10 is another perspective view of the tamper resistant box of FIG. 3 partially assembled.

Referring to FIGS. 9 and 10, a top of the tamper resistant box 301 can be assembled by folding the first side top flap 138 inward such that the first cut out 142 engages the first locking tab 180 of the first side bottom flap 172 by positioning the first locking tab 180 within the first cut out 142. Similarly, the second side top flap 152 can be folded inward such that the second cut out 156 engages the second locking tab 182 of the second side bottom flap 174 by positioning the second locking tab 182 within the second cut out 156. In some aspects, the side top flaps 138 and 152 are folded such that they are substantially perpendicular to the panels 102-108. In some examples, the locking tabs 180 and 182 positioned within the cut outs 142 and 156, respectively, can secure the side bottom flaps 172 and 174, respectively. In these examples, this can prevent the side bottom flaps 172 and 174 from moving inward towards a center of the cavity 503 defined by the tamper resistant box 301 and interfering with the operation and filling of the tamper resistant box 301 by the customer attempting to load paper or other items through the top slot 196. In some examples where the cut outs 142 and 156 and the locking tabs 180 and 182 are omitted, the side bottom flaps 172 and 174 may be able to move inward toward the center of the cavity 503. For example, the side bottom flaps 172 and 174 may be angled at about 45 degrees relative to the bottom front flap 166, which may substantially impacting the ability to feed paper or other items into the top slot 196.

As previously described, in some aspects, the side slots 144 and 160 can be offset from the center fold lines 146 and 158, respectively. In other examples, the top slot 196 may also be offset from a center of the top front flap 164 such that the top slot 196 is positioned closer to either of the fold lines 168 or 194. In some aspects, the offset side slots 144 and 160 can reduce weakening of the side top flaps 138 and 152, respectively, and can reduce the possibility of tearing of the side top flaps 138 and 152 along the center fold lines 146 and 158, respectively. The offset side slots 144, 160 can also reduce the possibility of tearing along the center fold lines 136 and 150 of the first side panel 104 and the second side panel 108, respectively. In some aspects, as described above, the side slots 144 and 160 can define side slot widths that are wider than the width of the top slot 196. In a further aspect, the side slots 144 and 160 can be tapered such that the side slots 144 and 160 are wider the farther the position from the fold lines 140 and 154, respectively. In some aspects, tapered side slots 144 and 160 may allow for interference-free operation of top slot 196 on top front flap 164. In this aspect, the tapered side slots 144 and 160 can provide a tolerance for inserting papers or other items through the top slot 196 in the event there is any misalignment of the tamper resistant box 301, such as misalignment of the top front flap 164 and the side top flaps 138 and 152, during assembly or manufacture. In this aspect, the customers can freely insert papers without the top slot 196 being blocked. For example, if the side slots 144 and 160 were sized to correspond to the size of top slot 196, there may be interference and blockage of the top slot 196 if there were any misalignment of the box 301 during assembly or manufacture.

To complete the assembly of the top of the box 301 prior to use by the customer, the top front flap 164 can be folded along the fold line 168 such that the top front flap 164 is positioned above the side top flaps 138 and 152. In some aspects, the top front flap 164 can contact and be positioned against the side top flaps 138 and 152. In other aspects, the top front flap 164 can be substantially perpendicular to the panels 102-108. In some examples, the closing flap 192 can be folded along the fold line 194 and tucked into the cavity 503 proximate to the back panel 102. After the top front flap 164 is positioned, the box 301 can be used by the customer, who may insert shreddable documents or other items into the box 301 through top slot 196.

When a sufficient number of shreddable documents have been inserted into the box, the customer may seal the box 301. To close the box 301, the customer can utilize the securing mechanism 105 to secure the top back flap 122 to the top front flap 164 and block access to the top slot 196. In examples where the securing mechanism 105 is an adhesive such as security tape, the customer can peel release paper off the security tape. In some embodiments the securing mechanism 105 can be double-sided tape, which can both permanently secure the top back flap 122 to the top front flap 164 and provide rigidity to the box 301 during shipment. In another aspect, the securing mechanism can provide evidence of tampering if anyone were to try and access the contents of the box 301 by opening the top back flap 122.

In some aspects, the securing flap 130 can be folded along the fold line 132 and inserted into the securing slot 107. In another aspect, the securing flap 186 may be folded along the fold lines 188 and 190 such that the securing flap 186 can be inserted into the slot 184. The customer can apply pressure to the top back flap 122 along the position of the securing mechanism 105 to complete the sealing process. In this aspect, the box 301 is securely sealed in a tamper-evident container, as removal of top back flap 122 will damage the securing mechanism 105, making it apparent that the box 301 has been tampered with.

Figure 3:
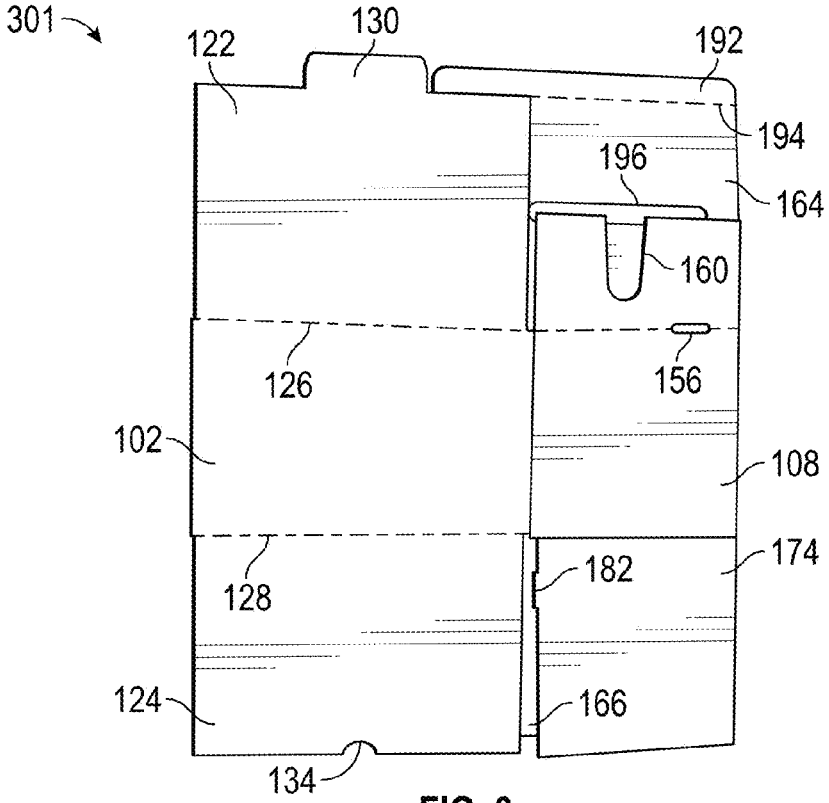
FIG. 3 is a top view of the tamper resistant box formed from the blank of FIG. 1 in a folded configuration.
Figure 4:
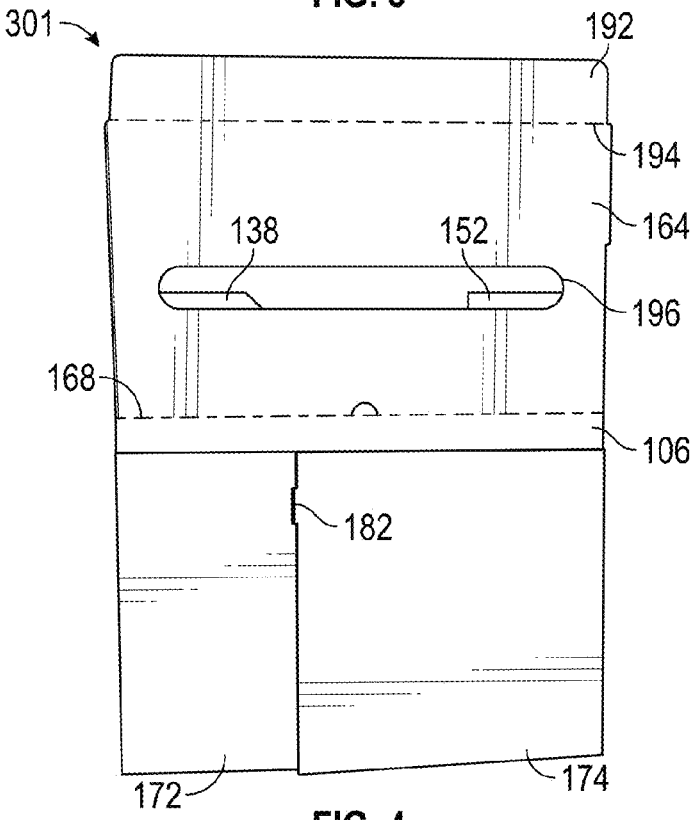
FIG. 4 is another top view of the tamper resistant box of FIG. 3 in a packaged configuration.

As discussed above, the side panels 104 and 108 comprise the center fold lines 136 and 150, respectively. As illustrated in FIG. 4, the center fold lines 136 and 150 can allow the box 301 to be knocked down during preparation for retail packaging to enable a smaller footprint compared to what would normally be available. As one non-limiting example, in an assembled box 301 having dimensions of 14¾" L×9¾" W×9⅛" H (which could hold approximately 1500-2000 sheets of shreddable paper depending on the loading), the footprint of the width of the box 301 when in the flat, unassembled state is approximately 24¾". During retail packing, the side panels 104 and 108 can be folded inward along the center fold lines 136 and 150, respectively, to reduce the footprint to the width of the box 301, which in the present example can be approximately 15". The bottom front flap 166, bottom back flap 124, and side bottom flaps 172 and 174 can be folded along the fold lines 170, 128, 176, 178, respectively, to further reduce the retail packaging foot print. FIG. 3 illustrates a traditional knocked down flat footprint of a box 301 where the center fold lines 136 and 150 are omitted, which has dimensions of 24½" W×30¾" H, or 5.23 $ft^2$. FIG. 4 illustrates the knocked down box 301 that includes the center fold lines 136 and 150, which has the dimensions of 15¼" W×21" H, or 2.22 $ft^2$. Accordingly, in this non-limiting example, the box 301 that utilizes the center fold lines 136 and 150 can have about a 57.5% reduction in footprint. In some aspects, the reduced footprint can allow for a more efficient use of a retailer's floor or shelf space.

The box may be formed of any suitable materials, including but not limited to cardboard, fiberboard (e.g., corrugated fiberboard), plastic, wood etc. In one embodiment, the box if formed by first stamping the blank 100 out of cardboard and then imparting the fold lines to the blank 100. The box may be formed by an integrally-formed blank or may be assembled from individual panels, all of which are not formed integrally.

Embodiments of the invention further relate to methods for the customer to arrange to ship the box 301 containing shreddable documents to a secure shredding facility by way of a certified shipper and to receive a certificate of completion from the shredding facility indicating that the documents have been shredded.

In the method, the customer accesses a website (e.g., by a PC or mobile device) for the secure shredding facility (e.g., Iron Mountain™) and enters shipping information for the box 301 containing shreddable documents (e.g., name, home address, telephone number, email address, billing and payment information). The secure shredding facility can provide the customer with a shipping label for a certified shipper (e.g., UPS), which the customer prints out and applies to the sealed box 301. The customer then brings the box 301 to the shipper or contacts the shipper and arranges to have the box 301 picked up, and the box 301 is shipped to the secure shredding facility, which shreds the documents when they are received and sends a certificate of completion to the customer at the email address and/or home address provided.

Figure 12:
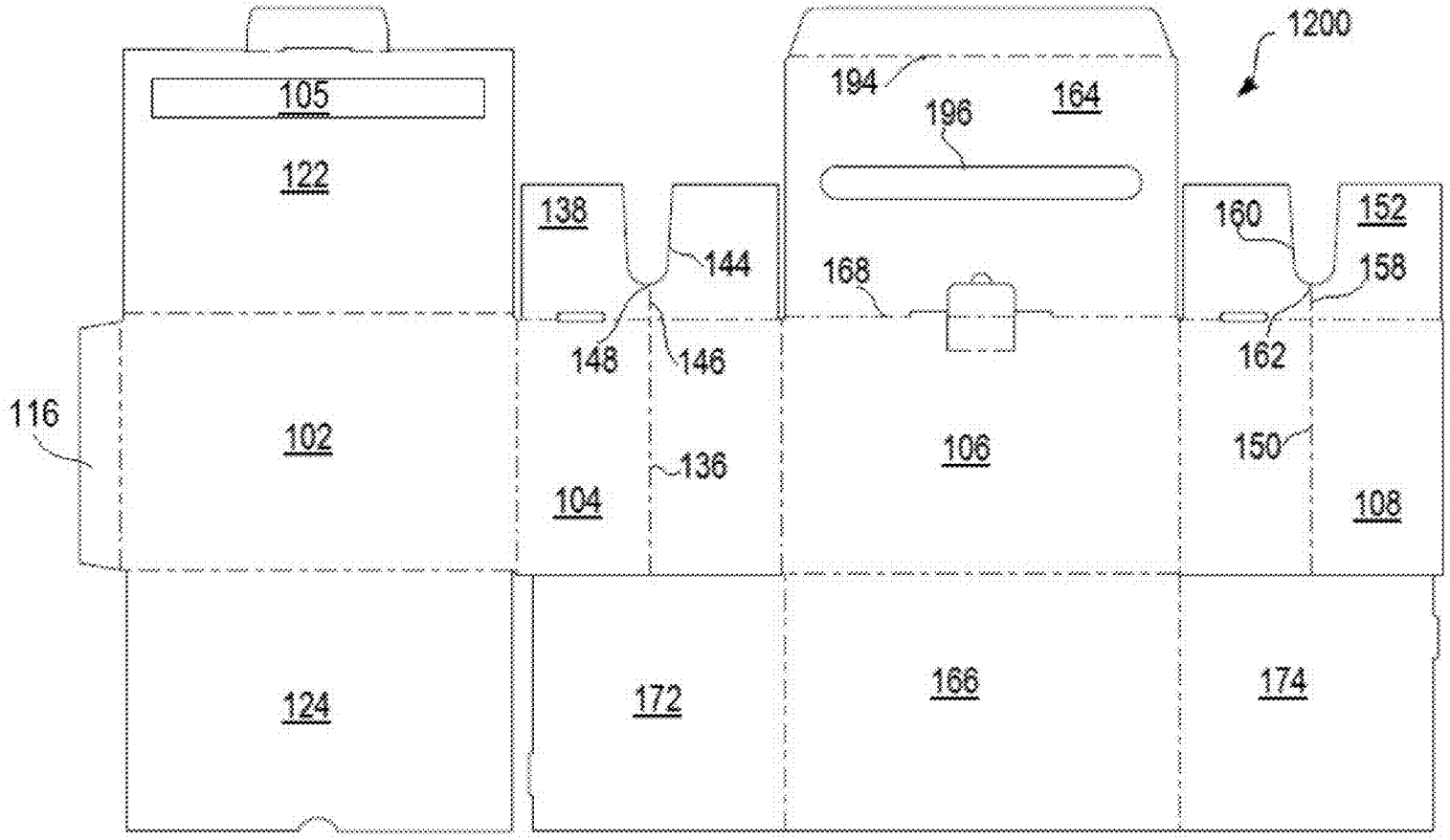
FIG. 12 is a top view of a blank for a tamper resistant box in accordance with another example of the current disclosure.

FIG. 12 illustrates another example of a blank 1200 for a tamper resistant box. As illustrated in FIG. 12, in this example, the side slot 144 is aligned with the center fold line 146 such that the innermost extent 148 of the slot 144 is aligned with the center fold line 146 and the side slot 160 is aligned with the center fold line 158 such that the inner most extent 162 of the slot 160 is aligned with the center fold line 158. In this example, the top slot 196 is centrally positioned between the fold lines 168 and 194.

Figure 13:
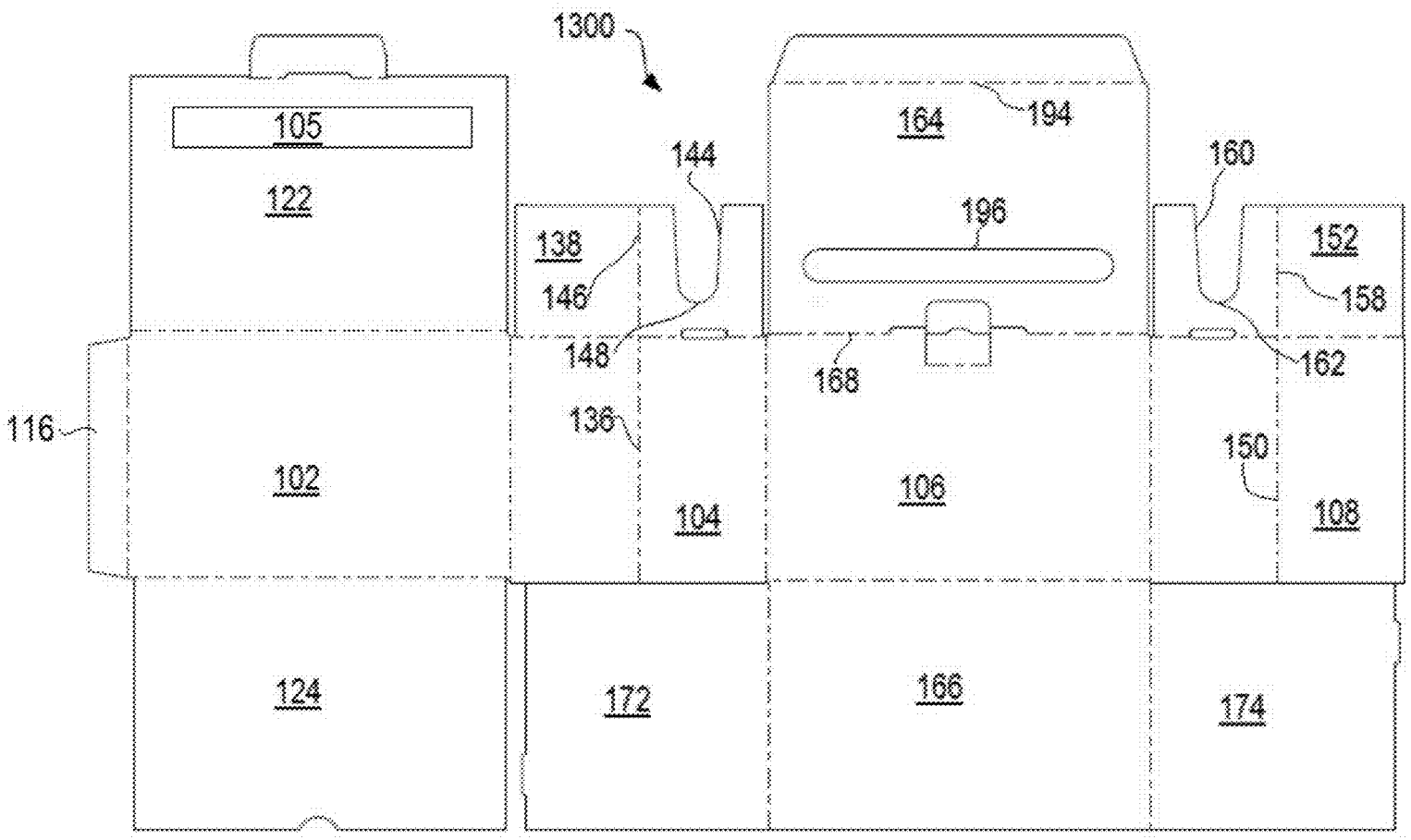
FIG. 13 is a top view of a blank for a tamper resistant box in accordance with another example of the current disclosure.

FIG. 13 illustrates another example of a blank 1300 for a tamper resistant box. As illustrated, in this example, the side slot 144 is further offset from the center fold line 146 compared to the slot 144 of the blank 100. In this example, the innermost extent 148 of the slot 144 is offset from the center fold line 146. In a similar manner, the side slot 160 is further offset from the center fold line 158 compared to the slot 160 of the blank 100. In this example, the inner most extent 162 of the slot 160 is offset from the center fold line 158. In another aspect, as illustrated in FIG. 13, the top slot 196 is positioned between the fold lines 168 and 194 and at a position closer to the fold line 168. In this aspect, the top slot 196 is not centrally positioned between the fold lines 168 and 194.

Figure 14:
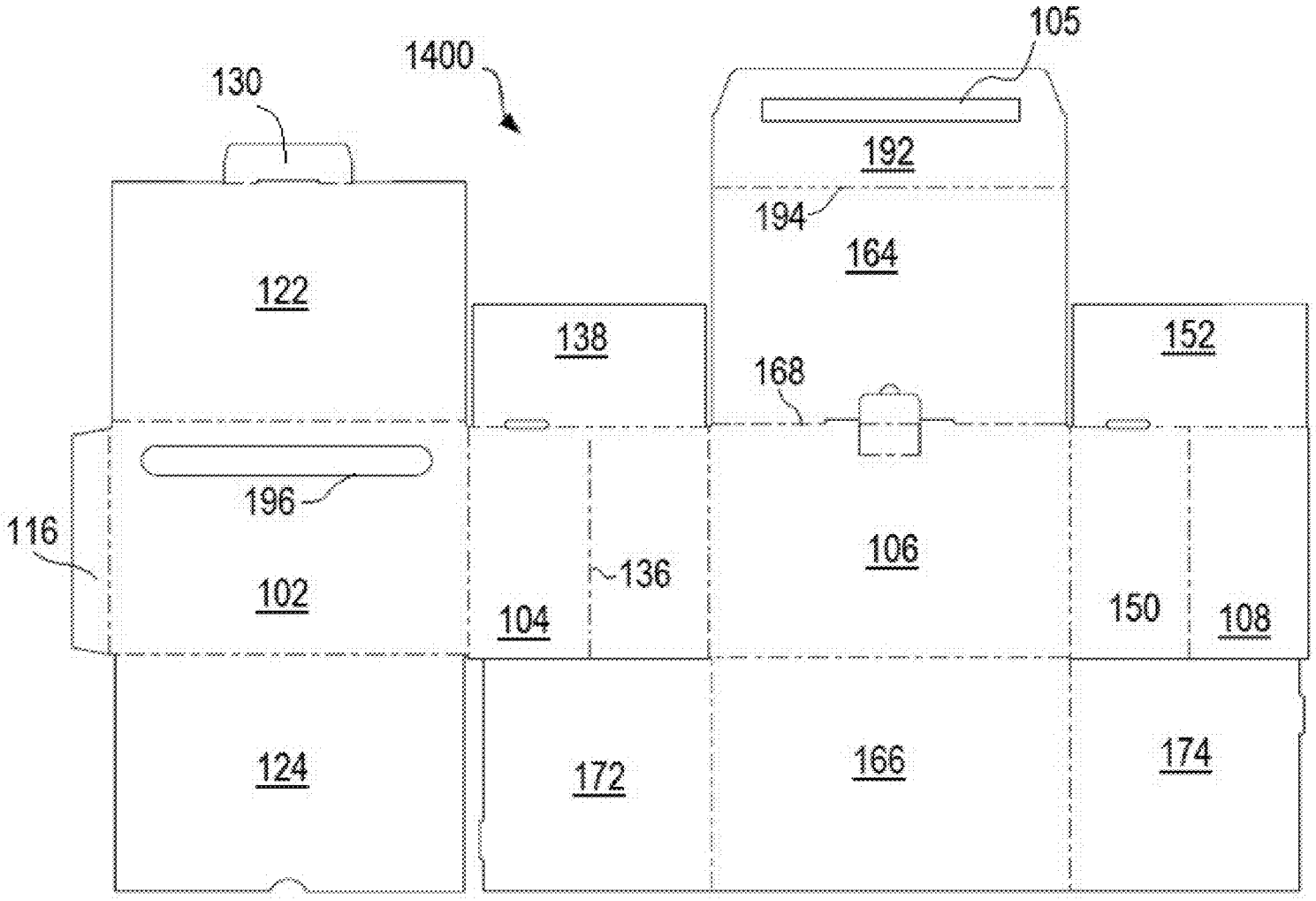
FIG. 14 is a top view of a blank for a tamper resistant box in accordance with another example of the current disclosure.

FIG. 14 illustrates another example of a blank 1400 for a tamper resistant box. As illustrated, in this example, the side top flaps 138 and 152 are solid flaps and do not define the slots 144 and 160, respectively. In another aspect, the closing flap 192 attached to the top front flap 164 is elongated relative to the closing flaps of the blanks 100, 1200, and 1300. In this aspect, a distance from the fold line 194 to an edge of the closing flap 192 distal from the fold line 194 in the blank 1400 is greater than a distance from the fold line 194 to the edge of the closing flap 192 distal from the fold line 194 in the blanks 100, 1200, and 1300. In some aspects, the closing flap 192 is dimensioned such that the closing flap 192 can cover the top slot 196 when the box formed from the blank 1400 is assembled. In another aspect, the closing flap 192 can comprise the securing mechanism 105, which is described in greater detail below. In a further aspect, the slot 196 can be defined on the back panel 102. One having skill in the art will appreciate that the location of the slot 196 on the back panel 102 should not be considered limiting on the current location.

In some aspects, the assembly of the blank 1400 to form the bottom of a tamper resistant box is substantially the same as described above with reference to the blank 100 and the box 301. In other aspects, to complete the assembly of the top of the box prior to use by the customer, the top back flap 122 can be folded to set up the box and remain closed while shreddable documents are inserted into the box via the slot 196. In this aspect, the top back flap 122 can be utilized to help maintain the shape of the box, for example by squaring up the box. In some aspects, the securing flap 130 can be positioned within a cavity defined by the box. After the top back flap 122 is positioned, the box can be used by the customer, who may insert shreddable documents or other items into the box through top slot 196.

When a sufficient number of shreddable documents have been inserted into the box, the customer may seal the box. To close the box, the top front flap 164 is positioned over the top back flap 122 and the customer can utilize the securing mechanism 105 to secure the closing flap 192 to the back panel 102 and block access to the slot 196. The top front flap 164 positioned over the top back flap 122 can provide double wall protection similar to the positioning of the bottom flaps 124 and 166 at the bottom of the box. In this aspect, the box may be a durable container to withstand the rigors of shipping.

A collection of exemplary embodiments, including at least some explicitly enumerated as "ECs" (Example Combinations), providing additional description of a variety of embodiment types in accordance with the concepts described herein are provided below. These examples are not meant to be mutually exclusive, exhaustive, or restrictive; and the invention is not limited to these example embodiments but rather encompasses all possible modifications and variations within the scope of the issued claims and their equivalents.

EC 1. A tamper resistant box comprising: a front panel; a side panel attached to the front panel at a first fold line; a back panel attached to the side panel at a second fold line; a side top flap attached to the side panel at a third fold line, the side top flap defining a tapered slot extending towards the third fold line from an edge of the side top flap at a location distal from the third fold line, a widest portion of the tapered slot defining a tapered slot width; and a front top flap attached to the front panel at a fourth fold line, the front top flap defining a top slot having a top slot width that is less than the tapered slot width, the front top flap positioned above the side top flap such that the top slot is positioned above the tapered slot.

EC 2. The tamper resistant box of any of the preceding or subsequent example combinations, wherein the side panel is a first side panel, the tapered slot is a first tapered slot, and the side top flap is a first side top flap, and wherein the tamper resistant box further comprises: a second side panel attached to the front panel at a location distal from the first side panel at a fifth fold line; and a second side top flap attached to the second side panel at a sixth fold line, the second side top flap defining a second tapered slot extending towards the sixth fold line from an edge of the second side top flap at a location distal from the sixth fold line, a widest portion of the second tapered side having the tapered slot width, wherein the front top flap is positioned above the second side top flap such that the top slot is positioned above the second tapered slot.

EC 3. The tamper resistant box of any of the preceding or subsequent example combinations, further comprising a securing panel attached to the back panel at a seventh fold line distal from the second fold line, wherein the securing panel is secured to a portion of the second side panel at a location distal from the fifth fold line.

EC 4. The tamper resistant box of any of the preceding or subsequent example combinations, further comprising: a front bottom flap attached to the front panel at an eighth fold line distal from the front top flap; a first bottom side flap attached to the front bottom flap at a ninth fold line, the first bottom side flap defining a first locking tab at an edge distal from the ninth fold line; and a second bottom side flap attached to the front bottom flap at a location distal from the first bottom side flap at a tenth fold line, the second bottom side flap defining a second locking tab at an edge distal from the tenth fold line, wherein the first side top flap defines a first cut out, wherein the first locking tab is positioned within the first cut out, wherein the second side top flap defines a second cut out, and wherein the second locking tab is positioned within the second cut out.

EC 5. The tamper resistant box of any of the preceding or subsequent example combinations, further comprising: a back top flap attached to the back panel at an eleventh fold line; and a back bottom flap attached to the back panel at a location distal from the back top flap at a twelfth fold line, wherein the back bottom flap defines a gripping cut at an edge distal from the twelfth fold line.

EC 6. The tamper resistant box of any of the preceding or subsequent example combinations, wherein the back top flap is secured to the front top flap such that the back top flap covers the top slot.

EC 7. The tamper resistant box of any of the preceding or subsequent example combinations, wherein the side panel comprises a center fold line extending substantially parallel to the first fold line, and wherein the side top flap comprises a center fold line that is aligned with the center fold line of the side panel.

EC 8. A tamper resistant box comprising: a front panel; a side panel attached to the front panel at a first fold line, the side panel comprising a center fold line extending substantially parallel to the first fold line; a back panel attached to the side panel at a second fold line; a side top flap attached to the side panel at a third fold line, the side top flap comprising a center fold line that is aligned with the center fold line of the side panel, the side top flap defining a tapered slot extending toward the third fold line from an edge of the side top flap at a location distal from the third fold line, the tapered slot having an innermost extent offset from the center fold line of the side top flap; and a front top flap attached to the front panel at a fourth fold line, the front top flap defining a top slot along a center line of the front top flap extending substantially parallel to the fourth fold line, the front top flap positioned above the side top flap such that the top slot is positioned above the tapered slot.

EC 9. The tamper resistant box of any of the preceding or subsequent example combinations, wherein the side panel is a first side panel and the side top flap is a first side top flap, and wherein the tamper resistant box further comprises: a second side panel attached to the front panel at a location distal from the first side panel at a fifth fold line, the second side panel comprising a center fold line extending substantially parallel to the fifth fold line; and a second side top flap attached to the second side panel at a sixth fold line, the second side top flap comprising a center fold line that is aligned with the center fold line of the second side panel, the second side top flap defining a side slot extending from an edge of the second side top flap at a location distal from the sixth fold line towards the sixth fold line, the side slot of the second side top flap having an innermost extent offset from the center fold line of the second side top flap, the side slot of the second side top flap having a side slot width, wherein the front top flap is positioned above the second side top flap such that the top slot is positioned above the side slot of the second side top.

EC 10. The tamper resistant box of any of the preceding or subsequent example combinations, further comprising a securing panel attached to the back panel at a seventh fold line distal from the second fold line, wherein the securing panel is secured to a portion of the second side panel at a location distal from the fifth fold line.

EC 11. The tamper resistant box of any of the preceding or subsequent example combinations, wherein a widest portion of the tapered slot defines a tapered slot width, wherein the top slot defines a top slot width, and wherein the tapered slot width is greater than the top slot width.

EC 12. The tamper resistant box of any of the preceding or subsequent example combinations, further comprising a back top flap attached to the back panel at an eighth fold line, wherein the back top flap is secured to the front top flap such that the back top flap covers the top slot.

EC 13. A tamper resistant box comprising: a front panel; a side panel attached to the front panel at a first fold line, the side panel comprising a center fold line extending substantially parallel to the first fold line; a back panel attached to the side panel at a second fold line; a side top flap attached to the side panel at a third fold line, the side top flap defining a tapered slot extending towards the third fold line from an edge of the side top flap at a location distal from the third fold line, a widest portion of the tapered slot defining a tapered slot width; and a front top flap attached to the front panel at a fourth fold line, the front top flap defining a top slot having a top slot width that is less than the tapered slot width, the front top flap positioned above the side top flap such that the top slot is positioned above the tapered slot.

EC 14. The tamper resistant box of any of the preceding or subsequent example combinations, wherein an innermost extent of the tapered slot is offset from the center fold line of the side top flap.

EC 15. The tamper resistant box of any of the preceding or subsequent example combinations, wherein the side panel is a first side panel, the tapered slot is a first tapered slot, and the side top flap is a first side top flap, and wherein the tamper resistant box further comprises: a second side panel attached to the front panel at a location distal from the first side panel at a fifth fold line; and a second side top flap attached to the second side panel at a sixth fold line, the second side top flap defining a second tapered slot extending towards the sixth fold line from an edge of the second side top flap at a location distal from the sixth fold line, a widest portion of the second tapered side having the tapered slot width, wherein the front top flap is positioned above the second side top flap such that the top slot is positioned above the second tapered slot.

EC 16. The tamper resistant box of claim of any of the preceding or subsequent example combinations, wherein the second side panel comprises a center fold line extending substantially parallel to the fifth fold line, wherein an innermost extent of the first tapered slot is offset from the center fold line of the first side panel, and wherein an innermost extent of the second tapered slot is offset from the center fold line of the second side panel.

EC 17. The tamper resistant box of any of the preceding or subsequent example combinations, further comprising a back top flap attached to the back panel at a seventh fold line, wherein the back top flap is secured to the front top flap such that the back top flap covers the top slot; and a back bottom flap attached to the back panel at a location distal from the back top flap at a eighth fold line, wherein the back bottom flap defines a gripping cut at an edge distal from the eighth fold line.

EC 18. The tamper resistant box of any of the preceding or subsequent example combinations, wherein an adhesive on the back top flap secures the back top flap to the front top flap.

EC 19. The tamper resistant box of any of the preceding or subsequent example combinations, further comprising: a front bottom flap attached to the front panel at a ninth fold line distal from the front top flap; and a bottom side flap attached to the front bottom flap at a tenth fold line, the bottom side flap defining a locking tab at an edge distal from the tenth fold line, wherein the side top flap defines a cut out, and wherein the locking tab is positioned within the cut out.

EC 20. The tamper resistant box of any of the preceding or subsequent example combinations, wherein the top slot is centered between the fourth fold line and an edge distal from the fourth fold line.

It should be emphasized that the above-described aspects are merely possible examples of implementations, merely set forth for a clear understanding of the principles of the present disclosure. Many variations and modifications can be made to the above-described embodiment(s) without departing substantially from the spirit and principles of the present disclosure. All such modifications and variations are intended to be included herein within the scope of the present disclosure, and all possible claims to individual aspects or combinations of elements or steps are intended to be supported by the present disclosure. Moreover, although specific terms are employed herein, as well as in the claims which follow, they are used only in a generic and descriptive sense, and not for the purposes of limiting the described invention, nor the claims which follow Different arrangements of the components depicted in the drawings or described above, as well as components and steps not shown or described are possible. Similarly, some features and subcombinations are useful and may be employed without reference to other features and subcombinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications can be made without departing from the scope of the claims below.

That which is claimed is:

1. A tamper resistant box comprising:

a front panel;

a first side panel attached to the front panel at a first fold line;

a back panel attached to the side panel at a second fold line;

a first side top flap attached to the first side panel at a third fold line, the first side top flap defining a first tapered slot extending towards the third fold line from an edge of the first side top flap at a location opposite from the third fold line, a widest portion of the first tapered slot defining a tapered slot width;

a front top flap attached to the front panel at a fourth fold line, the front top flap defining a top slot having a top slot width that is less than the tapered slot width, the front top flap positioned above the first side top flap such that the top slot is positioned above the first tapered slot;

a second side panel attached to the front panel at a fifth fold line opposite from the first side panel;

a second side top flap attached to the second side panel at a sixth fold line, the second side top flap defining a second tapered slot extending towards the sixth fold line from an edge of the second side top flap at a location opposite from the sixth fold line, a widest portion of the second tapered slot having the tapered slot width;

a front bottom flap attached to the front panel at an seventh fold line opposite from the front top flap;

a first bottom side flap attached to the front bottom flap at an eighth fold line, the first bottom side flap defining a first locking tab at an edge opposite from the eighth fold line; and a second bottom side flap attached to the front bottom flap at a ninth fold line opposite from the first bottom side flap, the second bottom side flap defining a second locking tab at an edge opposite from the ninth fold line, wherein the first side top flap defines a first cut out, wherein the first locking tab is positioned within the first cut out, wherein the second side top flap defines a second cut out, and wherein the second locking tab is positioned within the second cut out, and wherein the front top flap is positioned above the second side top flap such that the top slot is positioned above the second tapered slot.

2. The tamper resistant box of claim 1, further comprising a securing panel attached to the back panel at a tenth fold line opposite from the second fold line, wherein the securing panel is secured to a portion of the second side panel at a location opposite from the fifth fold line.

3. The tamper resistant box of claim 1, further comprising:

a back top flap attached to the back panel at an eleventh fold line; and a back bottom flap attached to the back panel at a twelfth fold line opposite from the back top flap, wherein the back bottom flap defines a gripping cut at an edge opposite from the twelfth fold line.

4. The tamper resistant box of claim 3, wherein the back top flap is secured to the front top flap such that the back top flap covers the top slot.

5. The tamper resistant box of claim 1, wherein the first side panel comprises a center fold line extending substantially parallel to the first fold line, and wherein the first side top flap comprises a center fold line that is aligned with the center fold line of the first side panel.

6. A tamper resistant box comprising:

a front panel;

a side panel attached to the front panel at a first fold line, the side panel comprising a center fold line extending substantially parallel to the first fold line;

a back panel attached to the side panel at a second fold line;

a side top flap attached to the side panel at a third fold line, the side top flap comprising a center fold line that is aligned with the center fold line of the side panel, the side top flap defining a tapered slot extending toward the third fold line from an edge of the side top flap opposite from the third fold line, the tapered slot having an innermost extent offset from the center fold line of the side top flap; and a front top flap attached to the front panel at a fourth fold line, the front top flap defining a top slot along a center line of the front top flap extending substantially parallel to the fourth fold line, the front top flap positioned above the side top flap such that the top slot is positioned above the tapered slot.

7. The tamper resistant box of claim 6, wherein the side panel is a first side panel and the side top flap is a first side top flap, and wherein the tamper resistant box further comprises:

a second side panel attached to the front panel at a fifth fold line opposite from the first side panel, the second side panel comprising a center fold line extending substantially parallel to the fifth fold line; and a second side top flap attached to the second side panel at a sixth fold line, the second side top flap comprising a center fold line that is aligned with the center fold line of the second side panel, the second side top flap defining a tapered slot extending towards the sixth fold line from an edge of the second side top flap opposite from the sixth fold line, the tapered slot of the second side top flap having an innermost extent offset from the center fold line of the second side top flap, the tapered slot of the second side top flap having a tapered slot width, wherein the front top flap is positioned above the second side top flap such that the top slot is positioned above the tapered slot of the second side top flap.

8. The tamper resistant box of claim 7, further comprising a securing panel attached to the back panel at a seventh fold line opposite from the second fold line, wherein the securing panel is secured to a portion of the second side panel at a location opposite from the fifth fold line.

9. The tamper resistant box of claim 6, wherein a widest portion of the tapered slot defines a tapered slot width, wherein the top slot defines a top slot width, and wherein the tapered slot width is greater than the top slot width.

10. The tamper resistant box of claim 6, further comprising:

a back top flap attached to the back panel at a seventh fold line, wherein the back top flap is secured to the front top flap such that the back top flap covers the top slot.

11. A tamper resistant box comprising:

a front panel;

a side panel attached to the front panel at a first fold line, the side panel comprising a center fold line extending substantially parallel to the first fold line;

a back panel attached to the side panel at a second fold line;

a side top flap attached to the side panel at a third fold line, the side top flap defining a tapered slot extending towards the third fold line from an edge of the side top flap opposite from the third fold line, a widest portion of the tapered slot defining a tapered slot width;

a front top flap attached to the front panel at a fourth fold line, the front top flap defining a top slot having a top slot width that is less than the tapered slot width, the front top flap positioned above the side top flap such that the top slot is positioned above the tapered slot;

a front bottom flap attached to the front panel at a fifth fold line opposite from the front top flap; and a bottom side flap attached to the front bottom flap at a sixth fold line, the bottom side flap defining a locking tab at an edge opposite from the sixth fold line, wherein the side top flap defines a cut out, and wherein the locking tab is positioned within the cut out.

12. The tamper resistant box of claim 11, wherein an innermost extent of the tapered slot is offset from the center fold line of the side top flap.

13. The tamper resistant box of claim 11, wherein the side panel is a first side panel and the side top flap is a first side top flap, and wherein the tamper resistant box further comprises:

a second side panel attached to the front panel at a seventh fold line opposite from the first side panel; and a second side top flap attached to the second side panel at an eighth fold line, the second side top flap defining a tapered slot extending towards the eighth fold line from an edge of the second side top flap opposite from the eighth fold line, a widest portion of the tapered slot of the second side top flap having the tapered slot width, wherein the front top flap is positioned above the second side top flap such that the top slot is positioned above the tapered slot of the second side top flap.

14. The tamper resistant box of claim of claim 13, wherein the second side panel comprises a center fold line extending substantially parallel to the seventh fold line, wherein an innermost extent of the tapered slot of the first side top flap is offset from the center fold line of the first side panel, and wherein an innermost extent of the tapered slot of the second side top flap is offset from the center fold line of the second side panel.

15. The tamper resistant box of claim 11, further comprising:

a back top flap attached to the back panel at a seventh fold line, wherein the back top flap is secured to the front top flap such that the back top flap covers the top slot; and a back bottom flap attached to the back panel at an eighth fold line opposite from the back top flap, wherein the back bottom flap defines a gripping cut at an edge opposite from the eighth fold line.

16. The tamper resistant box of claim 15, wherein an adhesive on the back top flap secures the back top flap to the front top flap.

17. The tamper resistant box of claim 11, wherein the top slot is centered between the fourth fold line and a seventh fold line opposite from the fourth fold line.

* * * * *